US007674215B1

(12) United States Patent
Swanson et al.

(10) Patent No.: US 7,674,215 B1
(45) Date of Patent: Mar. 9, 2010

(54) EXERCISE APPARATUS SEAT

(75) Inventors: Thor S. Swanson, Bensenville, IL (US); Kenneth S. Laughlin, Arlington Heights, IL (US); Michael Oliver, Lombard, IL (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/876,864

(22) Filed: Oct. 23, 2007

(51) Int. Cl.
*A63B 26/00* (2006.01)

(52) U.S. Cl. ..... 482/142

(58) Field of Classification Search ..... 482/142, 482/92–93, 104, 130, 133–138, 148, 140, 482/51, 56, 145; 297/13, 353, 354.1, 354.11, 297/354.12, 354.13, 372, 319–320, 377; *A63B 26/00*
See application file for complete search history.

(56) References Cited

U.S. PATENT DOCUMENTS

| | | | | |
|---|---|---|---|---|
| 4,582,319 | A | 4/1986 | Luna | |
| 4,635,934 | A | 1/1987 | Roethke | |
| 4,746,114 | A | 5/1988 | Grider | |
| 4,765,616 | A | 8/1988 | Wolff | |
| 4,834,453 | A * | 5/1989 | Makiol | 297/300.4 |
| 4,861,024 | A | 8/1989 | Lee | |
| 5,033,791 | A * | 7/1991 | Locher | 297/302.3 |
| 5,069,447 | A | 12/1991 | Snyderman et al. | |
| 5,350,346 | A | 9/1994 | Martinez | |
| 5,573,303 | A * | 11/1996 | Doerner | 297/300.5 |
| 5,669,865 | A | 9/1997 | Gordon | |
| 6,264,586 | B1 | 7/2001 | Webber | |
| 6,287,243 | B1 * | 9/2001 | Isom et al. | 482/142 |
| 6,406,412 | B1 * | 6/2002 | Chen | 482/140 |
| 6,471,624 | B1 | 10/2002 | Voris | |
| 6,645,130 | B2 | 11/2003 | Webber | |
| 6,659,923 | B2 | 12/2003 | Teuscher | |
| 6,805,409 | B2 | 10/2004 | Parker | |
| 6,884,203 | B2 * | 4/2005 | Forcillo | 482/142 |
| 6,966,872 | B2 | 11/2005 | Eschenbach | |
| 7,331,913 | B2 * | 2/2008 | Forcillo | 482/142 |
| 7,384,383 | B2 * | 6/2008 | Forcillo et al. | 482/140 |
| 7,465,260 | B2 * | 12/2008 | Hockemeyer | 482/142 |
| 2001/0018387 | A1 | 8/2001 | Webber | |
| 2003/0050157 | A1 | 3/2003 | Teuscher | |
| 2005/0032614 | A1 | 2/2005 | Keiser et al. | |
| 2005/0197238 | A1 | 9/2005 | Parker | |

* cited by examiner

*Primary Examiner*—Loan H Thanh
*Assistant Examiner*—Oren Ginsberg
(74) *Attorney, Agent, or Firm*—Andrus, Sceales, Starke & Sawall, LLP

(57) ABSTRACT

An exercise apparatus seat includes a seatbottom and a seatback each pivoted to a support frame at respective first and second stationary pivots, and coupled to each other at a third translational pivot.

9 Claims, 8 Drawing Sheets

FIG. 14
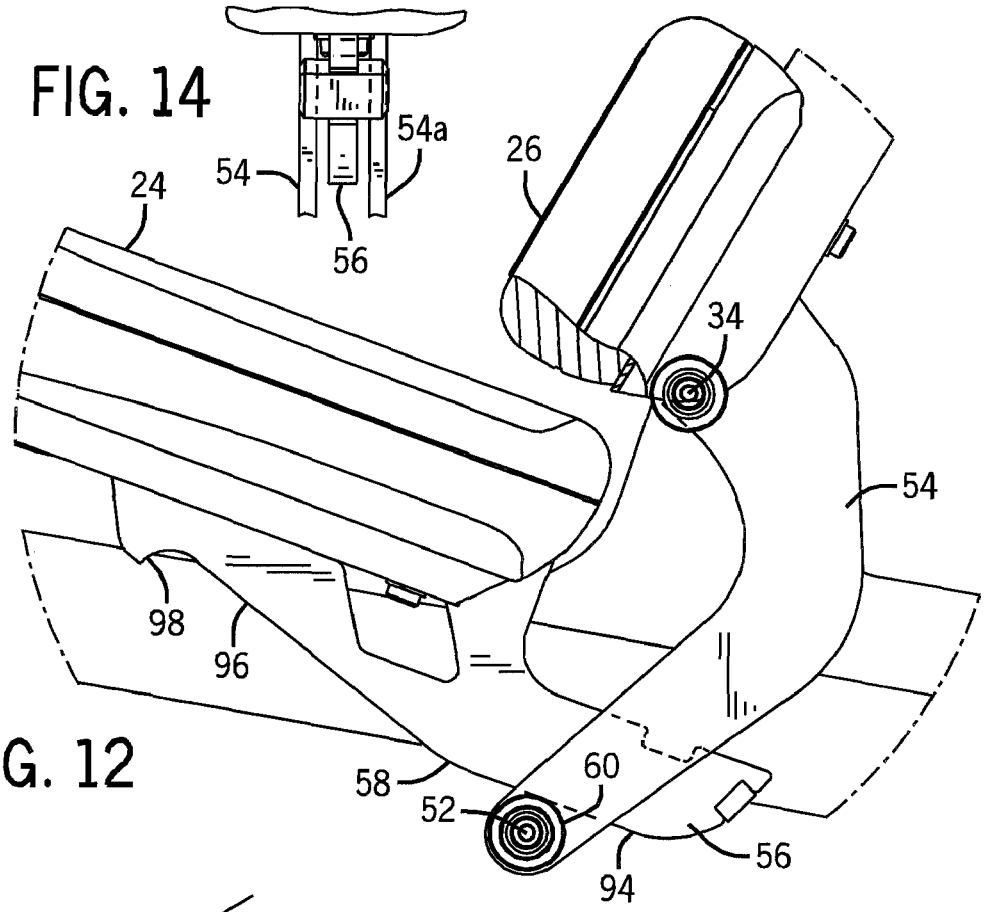
FIG. 12
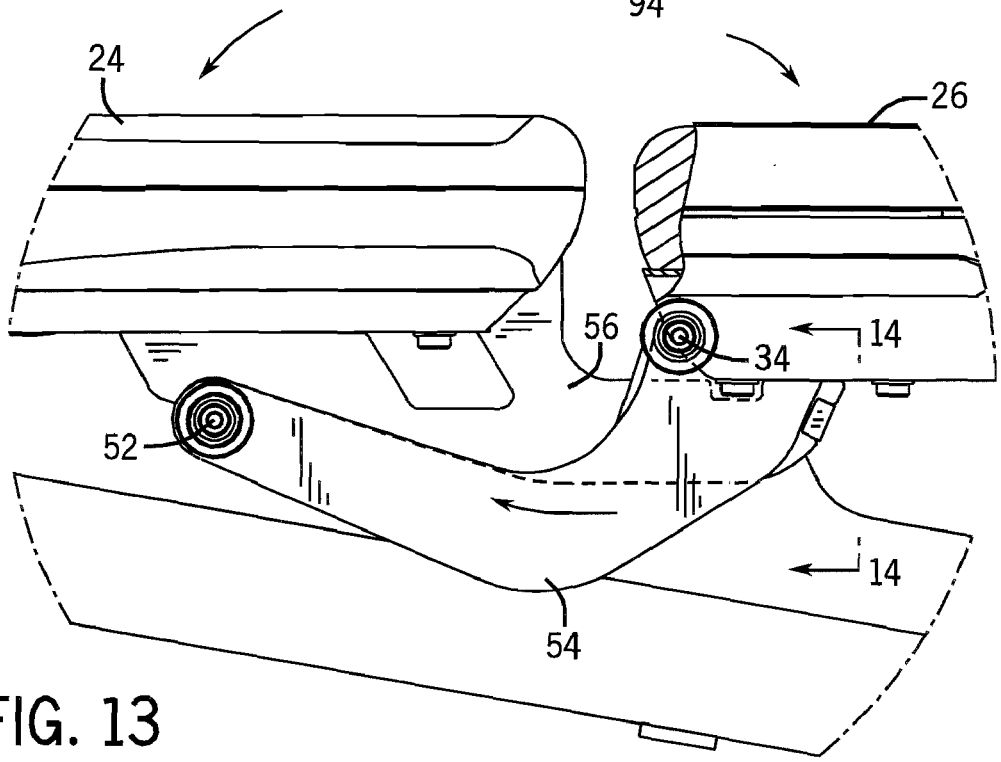
FIG. 13

EXERCISE APPARATUS SEAT

BACKGROUND AND SUMMARY

The invention relates to exercise apparatus, and more particularly to an exercise apparatus seat.

Exercise apparatus seats may include a seatbottom for supporting a user's buttocks and a seatback for supporting the user's back. Various support and adjustment mechanisms are known for varying the positions of the seatbottom and the seatback, to accommodate different users.

The present invention arose during continuing development efforts directed toward the noted exercise apparatus seats.

BRIEF DESCRIPTION OF THE DRAWINGS

FIG. 12 is an enlarged view taken along line 12-12 of FIG. 8.

FIG. 13 is like FIG. 10 and shows another position.

FIG. 14 is a view taken along line 14-14 of FIG. 13.

DETAILED DESCRIPTION

Figure 1:
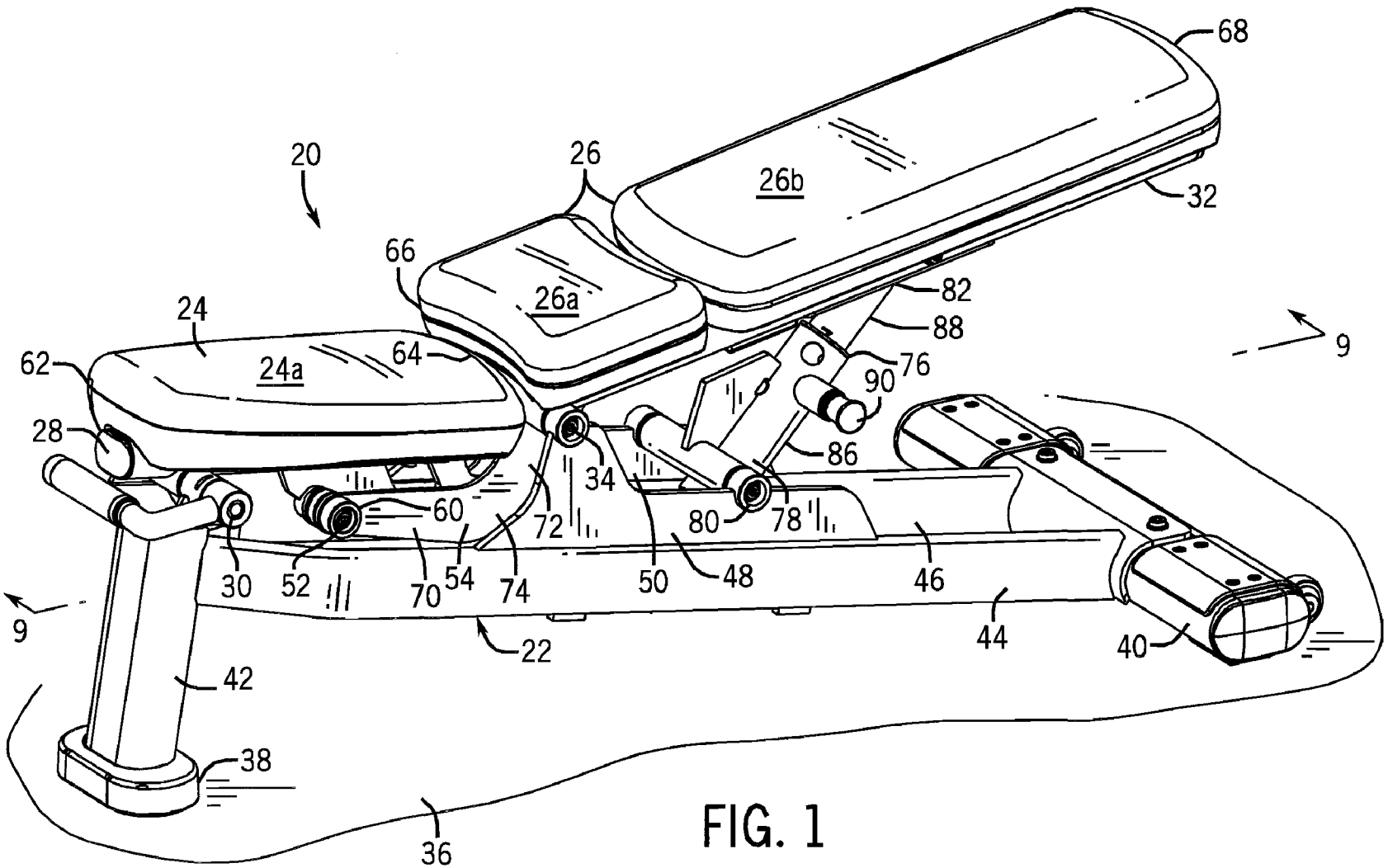
FIG. 1 is a perspective view of an exercise apparatus seat in accordance with the invention.
Figure 2:
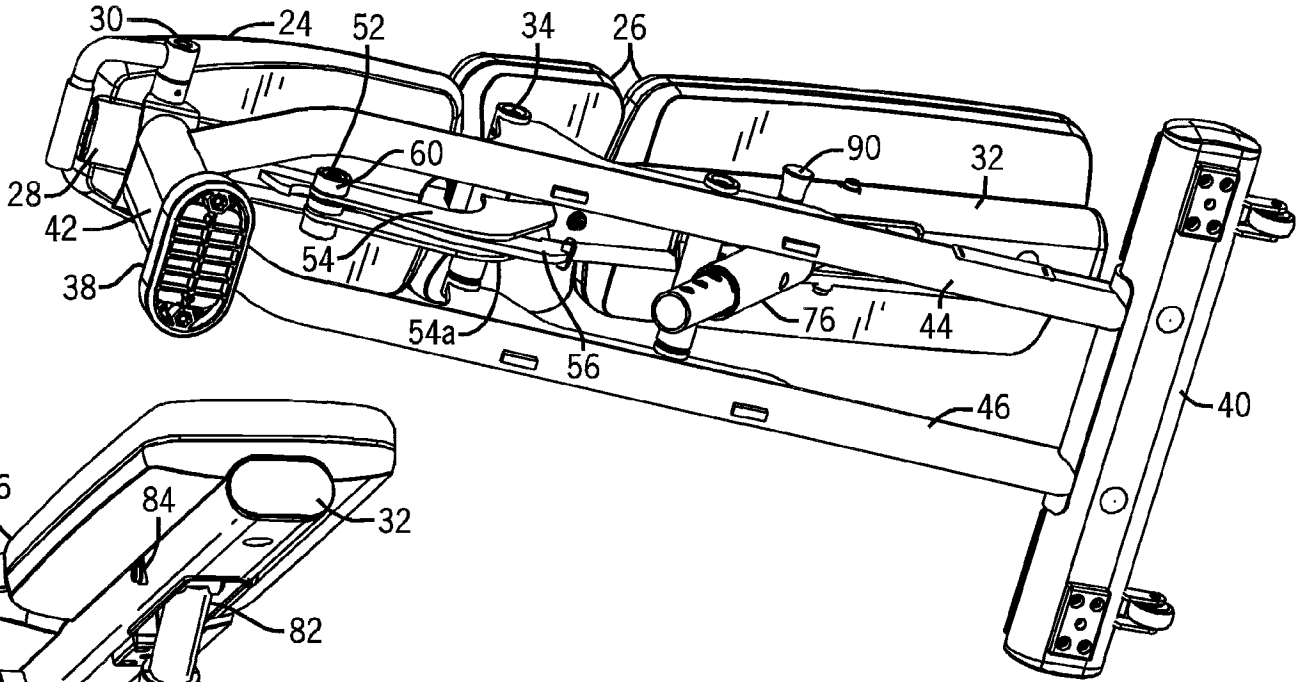
FIG. 2 is a perspective view from below of the seat of FIG. 1.
Figure 3:
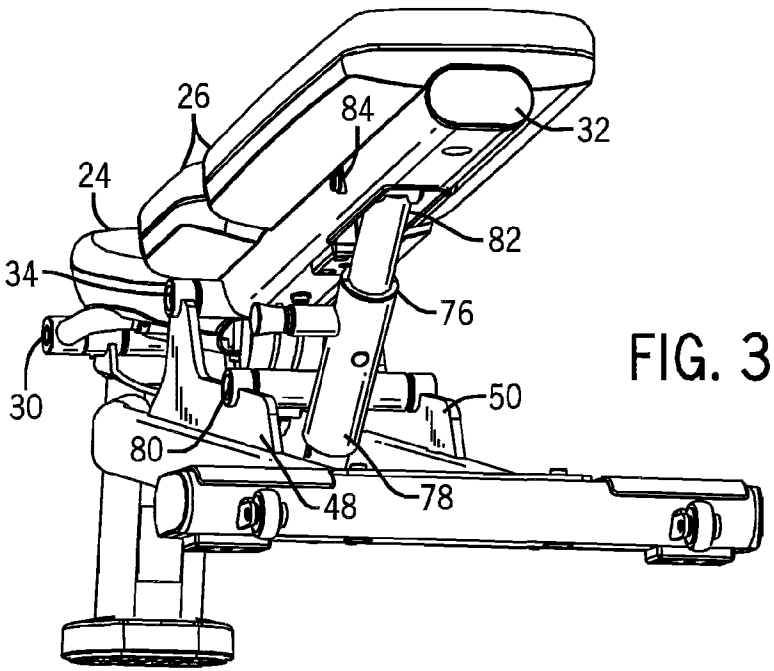
FIG. 3 is a perspective view from the rear of the seat of FIG. 1.

FIG. 1 shows an exercise apparatus seat 20 including a frame 22 having a seatbottom 24 for supporting a user's buttocks and a seatback 26, including lower pad 26*a* and upper pad 26*b*, for supporting the user's back. The seatbottom includes a pad portion 24*a* supported by a rigid tubular support member 28 pivotally mounted to the frame at a stationary first pivot 30, FIGS. 1-5. The seatback has the noted pads 26*a*, 26*b* supported on rigid tubular support member 32, FIG. 3, which is pivotally mounted to the frame at a stationary second pivot 34. Seatbottom 24 is swingable about pivot 30 to change positions of the seatbottom. Seatback 26 is swingable about pivot 34 to change positions of the seatback. Frame 22 is supported on floor 36 by front and rear feet 38 and 40, respectively. The frame as a front leg 42 extending upwardly from foot 38 to support the forward ends of a pair of longitudinally extending support braces 44 and 46 which extend diagonally rearwardly and downwardly to rear foot 40. Stationary pivot 30 is supported at the top of leg 42. Stationary pivot 34 is supported by upstanding flanges 48 and 50 extending upwardly from respective diagonal members 44 and 46.

Figure 5:
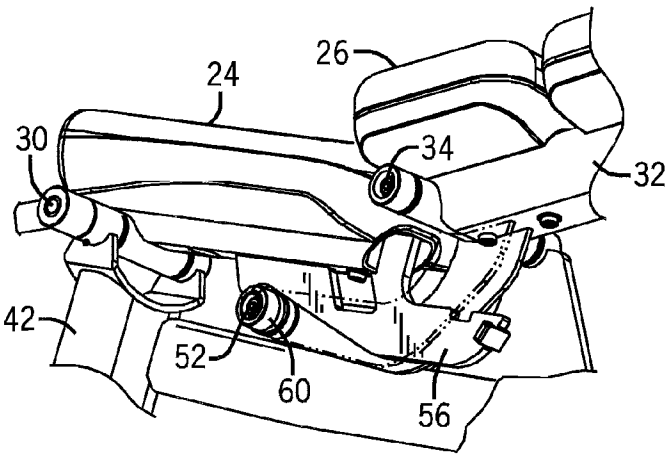
FIG. 5 is a perspective view of a portion to FIG. 1 from a different angle.
Figure 4:
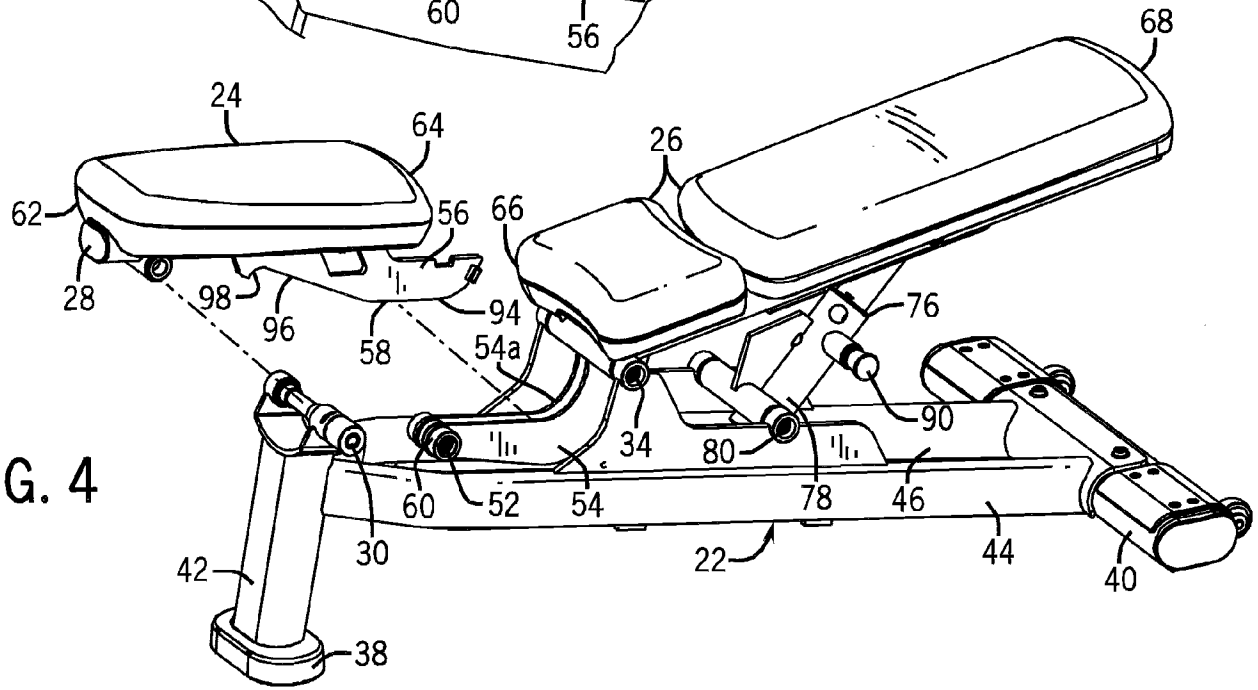
FIG. 4 is a partially exploded perspective view of the seat of FIG. 1.
Figure 6:
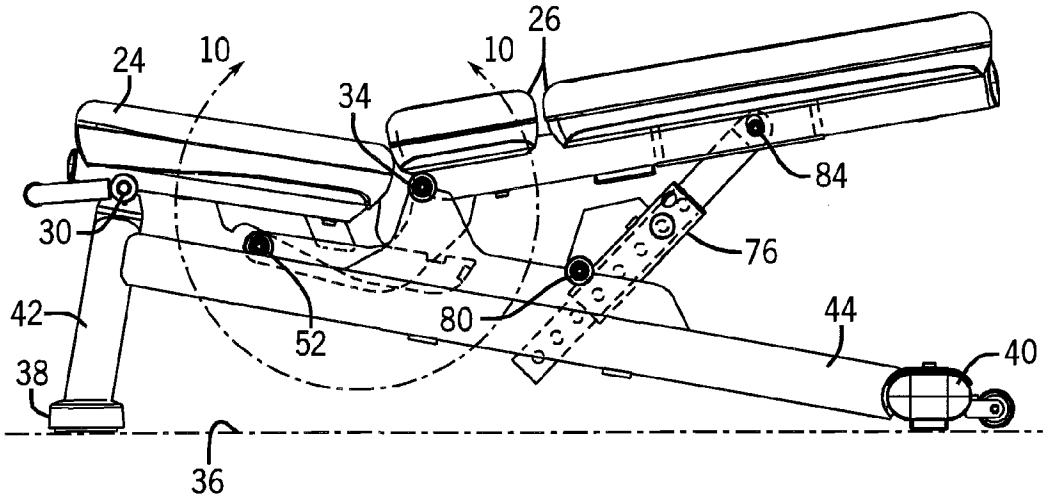
FIG. 6 is a side view of the seat of FIG. 1
Figure 7:
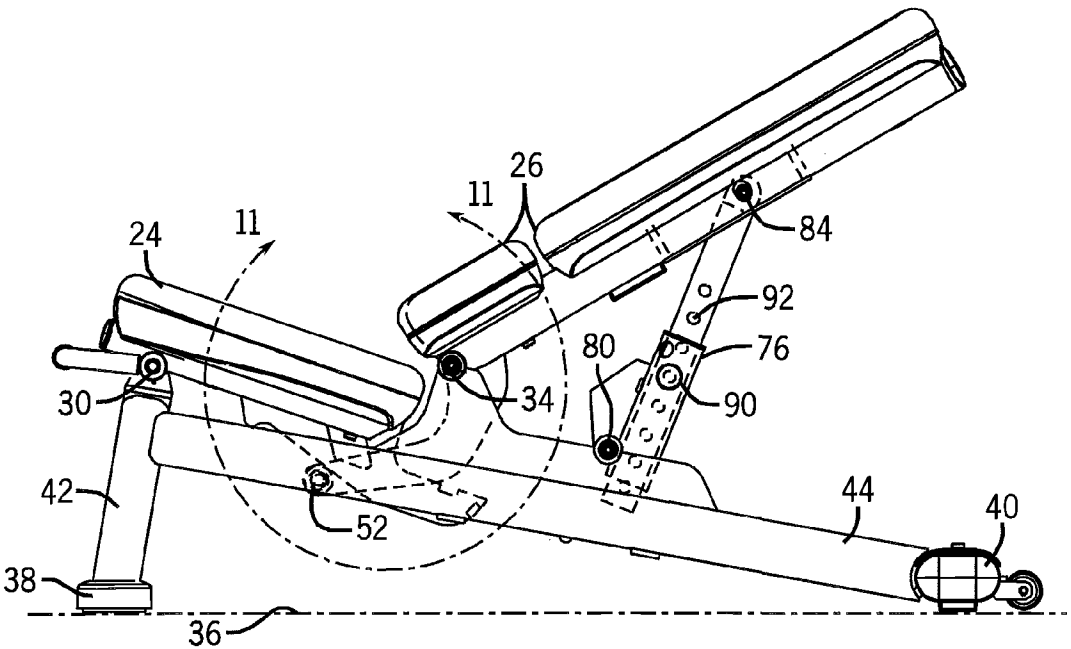
FIG. 7 is like FIG. 6 and shows another seat position.
Figure 8:
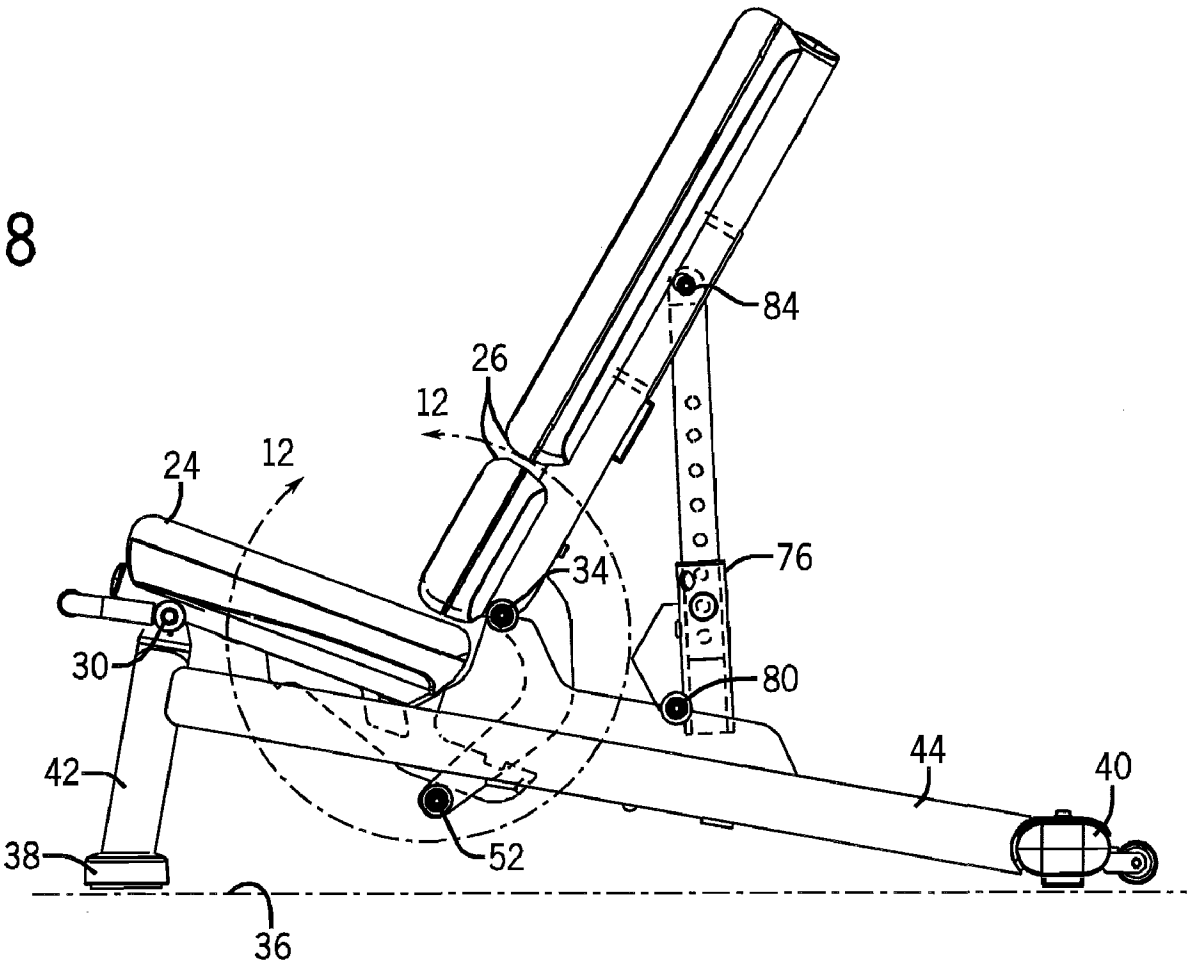
FIG. 8 is like FIG. 7 and shows another seat position.
Figure 9:
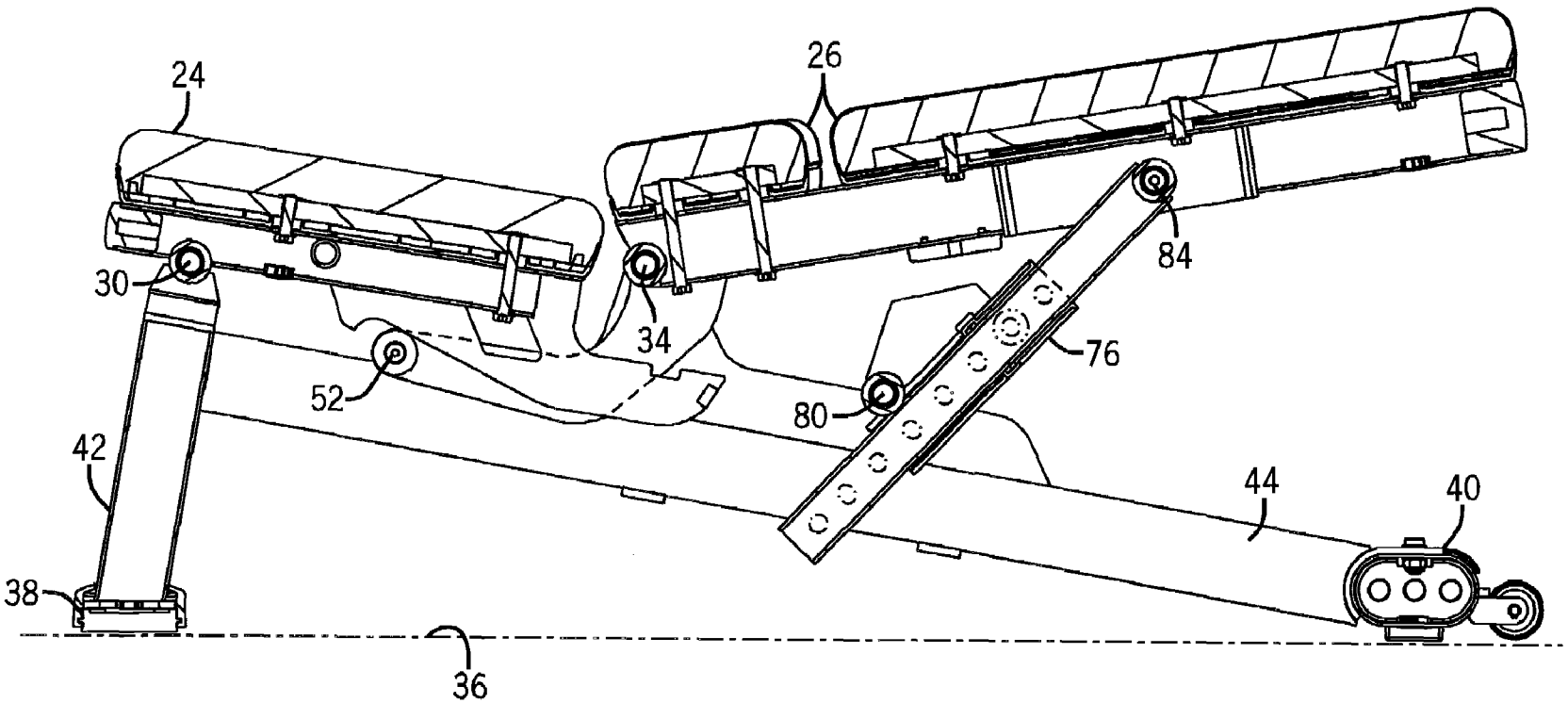
FIG. 9 is a sectional view taken along line 9-9 of FIG. 1.
Figure 10:
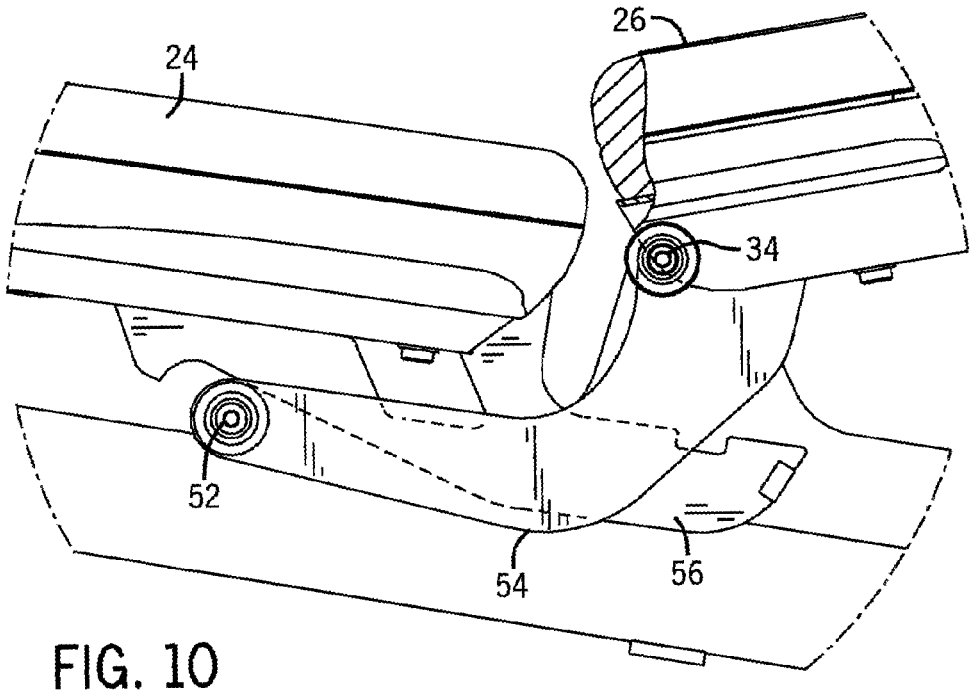
FIG. 10 is an enlarged view taken along line 10-10 of FIG. 6.
Figure 11:
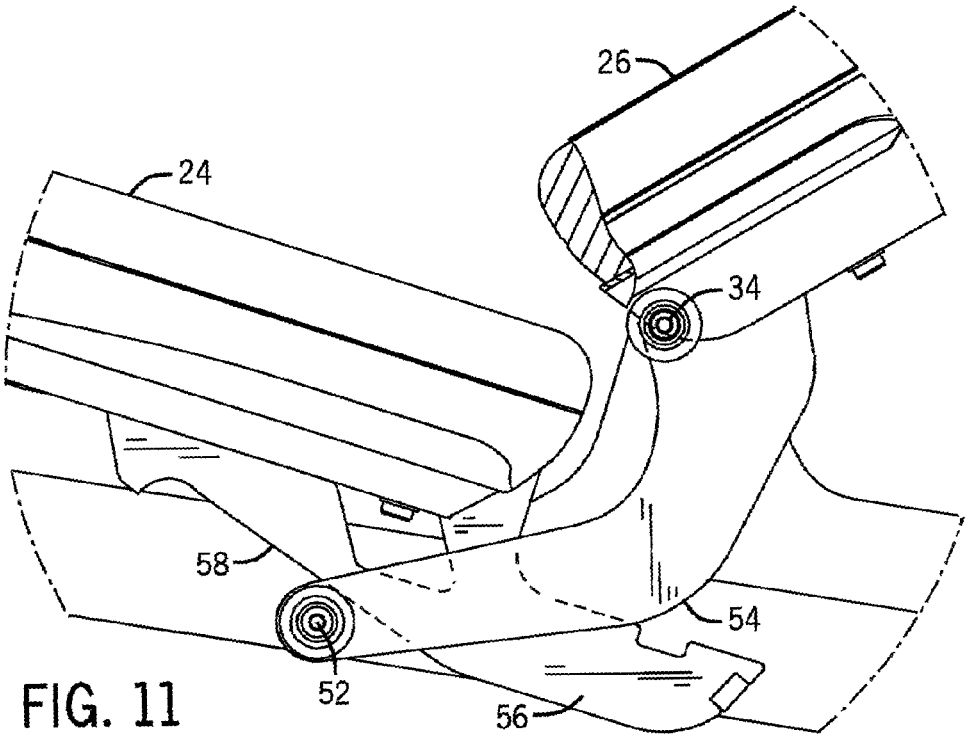
FIG. 11 is an enlarged view taken along line 11-11 of FIG. 7.

Seatbottom 24 and seatback 26 are coupled to each other at a third pivot 52, FIGS. 1, 4, 5, which translates, FIGS. 6-8, 9-12, along one of the seatbottom and seatback, preferably along the underside of the seatbottom. Seatback 26 has a boom arm 54 extending downwardly from support tube 32 and then forwardly below seatbottom 24. The seatbottom has a downwardly extending flange 56, FIG. 4, extending downwardly from the underside of support tube 28, which flange has a downwardly facing guide track 58 therealong. The noted third pivot 52 is provided by rotationally journaled rollers 60 on the forward end of boom arm 54 below seatbottom 24 and translationally rolling along guide track 58 during pivoting of the seatbottom and seatback about pivots 30 and 34, respectively, FIGS. 6-8, 10-12. Guide track 58 rests on and is supported by pivot 52 at roller 60. Roller 60 rolls along guide track 58 thereabove, with guide track 58 resting on and supported by roller 60 therebelow.

Seatbottom 24 has a forward end 62 pivotally mounted to frame 22 at stationary first pivot 30, and has a rearward end 64 adjacent seatback 26 and swingable in an arc about pivot 30 to change positions of the seatbottom. Seatback 26 has a lower end 66 adjacent seatbottom 24 and pivotally mounted to frame 22 at stationary second pivot 34, and has an upper end 68 swingable in an arc about pivot 34 to change positions of the seatback. Boom arm 54 is a generally L-shaped member having first and second legs 70 and 72 meeting at junction 74. First and second legs 70 and 72 extend from junction 74 respectively to third pivot 52 and seatback 26. Boom arm 54 is a rigid member such that pivot 52 is at a fixed radial distance from pivot 34 and swingable in an arc thereabout. Second leg 72 extends to seatback 26 adjacent pivot 34, and boom arm 54 and pivot 52 swing in an arc about pivot 34 upon pivoting of seatback 26. An extensible and retractable telescopic support post 76 has a lower end 78 pivotally mounted to flanges 48, 50 of frame 22 at a fourth pivot 80 spaced rearwardly of pivot 34, and has an upper end 82 pivotally mounted to support tube 32 of seatback 26 at a fifth pivot 84 spaced above lower end 66 of seatback 26. The retractable telescopic support post includes outer sleeve member 86 concentrically surrounding and telescopically receiving inner sleeve 88 therein for sliding movement therealong, and a lock pin 90 insertable into mating apertures such as 92 for locking the members 86 and 88 in place relative to each other which in turn sets the inclination angle of seatback 26 relative to frame 22.

Guide track 58 has a downwardly facing contoured profile extending forwardly from a rearward segment 94 to a forward segment 96, FIG. 4. Seatback 26 pivots between a first relatively upright position, FIGS. 8, 12, and a second relatively reclined position, FIG. 13, and a plurality of positions therebetween, FIGS. 6, 7, 9, 10, 11. Third pivot 52 at roller 60 engages rear segment 94 of the noted contoured profile when seatback 26 is in the noted first position, FIGS. 8, 12. Pivot 52 at roller 60 engages forward segment 96 of the noted contoured profile when seatback 26 is in the noted second position, FIG. 13. Forward segment 96 of the contoured profile has a barrier-slope at 98 resisting further forward movement of pivot 52 and roller 60 therealong to in turn resist further pivotal movement of seatback 26 beyond the noted second position to a further reclined position. This may be useful where it is desired to set the lower limit of reclining of seatback 26 to be parallel to seatbottom 24 and not to recline further to a negative angle relative to seatbottom 24. It is preferred that the noted guide track 58 provided by downwardly extending flange 56 be engaged by a pair of laterally spaced boom arms 54 and 54*a* extending in parallel from support tube 32 of seatback 26 and straddling guide track 58 and flange 56 therebetween.

The described structure desirably maintains a minimum gap between the rearward end 64 of seatbottom 24 and the lower end 66 of seatback 26 during the various relative upright and reclined positions thereof. This maintenance of a minimum gap during the various relative positions is enabled by the translational pivot at 52. Pivot 52 may slide along the noted guide track without a roller, but preferably is provided by a roller 60 translationally rolling therealong to provide a easy gliding motion. The construction is compact and simple.

In the foregoing description, certain terms have been used for brevity, clearness, and understanding. No unnecessary limitations are to be implied therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims.

What is claimed is:

1. An exercise apparatus seat comprising a frame having a seatbottom for supporting a user's buttocks and a seatback for supporting the user's back, said seatbottom being pivotally mounted to said frame at a first pivot and swingable about said first pivot to change positions of said seatbottom, said seatback being pivotally mounted to said frame at a second pivot and swingable about said second pivot to change positions of said seatback, said seatbottom and said seatback being coupled to each other at a third pivot which translates along a guide track along said seatbottom, wherein said guide track moves along an arcuate path of movement during translation of said third pivot along said guide track, said seatback comprises a boom arm extending downwardly and then forwardly below said seatbottom, said seatbottom has an underside having said guide track therealong, said third pivot is on said boom arm below said seatbottom and translates along said guide track during pivoting of said seatbottom and said seatback about said first and second pivots, respectively, said guide track rests on and is supported by said third pivot on said boom arm, said third pivot comprises a roller journaled to said boom arm and rolling along said guide track thereabove, said guide track resting on and supported by said roller therebelow.

2. The exercise apparatus seat according to claim 1 wherein:

said seatbottom has a forward end pivotally mounted to said frame at said first pivot, and has a rearward end adjacent said seatback and swingable in an arc about said first pivot to change positions of said seatbottom;

said seatback has a lower end adjacent said seatbottom and pivotally mounted to said frame at said second pivot, and has an upper end swingable in an arc about said second pivot to change positions of said seatback;

said boom arm is a generally L-shaped member having first and second legs meeting at a junction, said first and second legs extending from said junction respectively to said third pivot and said seatback, said boom arm being a rigid member such that said third pivot is at a fixed radial distance from said second pivot and swingable in an arc thereabout.

3. The exercise apparatus seat according to claim 2 wherein said second leg extends to said seatback adjacent said second pivot, and said boom arm and said third pivot swing in an arc about said second pivot upon pivoting of said seatback.

4. The exercise apparatus seat according to claim 2 comprising an extensible and retractable support post having a lower end pivotally mounted to said frame at a fourth pivot spaced rearwardly of said second pivot, and having an upper end pivotally mounted to said seatback at a fifth pivot spaced above said lower end of said seatback.

5. The exercise apparatus seat according to claim 1 wherein:

said guide track has a downwardly facing contoured profile extending forwardly from a rearward segment to a forward segment;

said seatback pivots between a first relatively upright position and a second relatively reclined position;

said third pivot engages said rearward segment of said contoured profile when said seatback is in said first position;

said third pivot engages said forward segment of said contoured profile when said seatback is in said second position.

6. The exercise apparatus seat according to claim 5 wherein said forward segment of said contoured profile has a barrier-slope resisting further forward movement of said third pivot therealong to in turn resist further pivotal movement of said seatback beyond said second position to a further reclined position.

7. The exercise apparatus seat according to claim 5 wherein said second position of said seatback is substantially parallel to said seatbottom.

8. The exercise apparatus seat according to claim 5 comprising a pair of laterally spaced boom arms extending in parallel from said seatback and straddling said guide track therebetween.

9. An exercise apparatus seat comprising a frame having a seatbottom for supporting a user's buttocks, and a seatback for supporting the user's back, said seatbottom having a forward end pivotally mounted to said frame at a stationary first pivot, said seatbottom having a rearward end adjacent said seatback and swingable in an arc about said first pivot to change positions of said seatbottom, said seatback having a lower end adjacent said seatbottom and pivotally mounted to said frame at a stationary second pivot, said seatback having an upper end swingable in an arc about said second pivot to change positions of said seatback, said seatbottom and seatback being coupled to each other at a third pivot which translates along said seatbottom, said seatback having a boom arm extending downwardly and then forwardly below said seatbottom, said seatbottom having an underside having a guide track therealong, said third pivot being on said boom arm below said seatbottom and translating along said guide track during pivoting of said seatbottom and said seatback about said first and second pivots, respectively, wherein said guide track moves along an arcuate path of movement during translation of said third pivot along said guide track, said guide track rests on and is supported by said third pivot on said boom arm, said third pivot comprises a roller journaled to said boom arm and rolling along said guide track thereabove, said guide track resting on and supported by said roller therebelow.

* * * * *